US007014519B1

(12) United States Patent
Batten, Jr. et al.

(10) Patent No.: US 7,014,519 B1
(45) Date of Patent: Mar. 21, 2006

(54) MARINE PROPULSION SYSTEM WITH A TILTED IN-LINE ENGINE

(75) Inventors: Cyril J. Batten, Jr., Stillwater, OK (US); Daniel B. Slanker, Stillwater, OK (US); Brian R. White, Stillwater, OK (US)

(73) Assignee: Brunswick Corporation, Lake Forest, IL (US)

( * ) Notice: Subject to any disclaimer, the term of this patent is extended or adjusted under 35 U.S.C. 154(b) by 0 days.

(21) Appl. No.: 10/903,703

(22) Filed: Jul. 30, 2004

(51) Int. Cl.
*B63H 11/00* (2006.01)

(52) U.S. Cl. ..... 440/38

(58) Field of Classification Search ..... 440/38
See application file for complete search history.

(56) References Cited

U.S. PATENT DOCUMENTS 4,040,379 A 8/1977 Betts ..... 115/37
4,940,436 A 7/1990 Newman ..... 440/112
5,634,832 A * 6/1997 Nakase et al. ..... 440/88 R
6,027,384 A * 2/2000 Nitta et al. ..... 440/75
6,095,876 A * 8/2000 Ozawa et al. ..... 440/88 R
6,302,751 B1 * 10/2001 Nanami ..... 440/84
6,578,508 B1 * 6/2003 Hattori et al. ..... 114/55.57

* cited by examiner

*Primary Examiner*—Stephen Avila
(74) *Attorney, Agent, or Firm*—William D. Lanyi

(57) ABSTRACT

A marine propulsion system places an in-line engine at a tilted angle relative to a vertical plane in order to reduce the maximum height requirement space of an engine compartment in a marine vessel. The crankshaft axis of the in-line engine can be located on a vertical vessel symmetry plane or can be offset from it. The crankshaft of the inline engine can be disposed parallel to the vessel symmetry plane, within the vessel symmetry plane, or perpendicular to the vessel symmetry plane.

25 Claims, 8 Drawing Sheets

MARINE PROPULSION SYSTEM WITH A TILTED IN-LINE ENGINE

BACKGROUND OF THE INVENTION

1. Field of the Invention

The present invention is generally related to a marine propulsion system that uses an in-line engine and, more particularly, to a system in which the in-line engine is tilted at a preselected angle from a generally vertical plane.

2. Description of the Prior Art

Marine propulsion systems use engines of various types. Inboard marine propulsion systems and sterndrive systems typically dispose the engine within the hull structure of a marine vessel. In most typical applications of internal combustion engines associated with inboard or sterndrive systems, the engine is aligned symmetrically relative to a generally vertical plane with its crankshaft disposed in parallel relation with a vertical plane that bisects the hull of the marine vessel in a direction extending from its bow to its stern. However, not all marine propulsion systems meet this description of the typical application.

U.S. Pat. No. 4,040,379, which issued to Betts on Aug. 9, 1977, describes a dual sterndrive mounting arrangement. A boat includes a boat hull having a centerline, a pair of sterndrive units supported by the boat hull and each including an engine. A shaft driven by the engine has an axis of rotation extending at an angle to the boat centerline so that the axes converge in a rearward direction, a propulsion unit disposed rearwardly of the engine and a propeller driven by the shaft. It also includes a unit supporting the propulsion unit for steering movement relative to the boat hull.

U.S. Pat. No. 4,940,436, which issued to Newman on Jul. 10, 1990, describes a marine engine system with inboard mounted engine and depending drive unit. A marine drive system includes one or more engines mounted inboard of a boat adjacent the boat transom. The engines are disposed such that their longitudinal axes are substantially perpendicular to the boat centerline and parallel to the boat transom. A drive unit extends substantially vertically relative to each engine during operation. The drive unit preferably includes a drive housing which is mounted to the boat so as to be pivotable between an operating position, in which the propeller is submerged, and an inoperative position in which the propeller is out of the water and the drive unit is disposed at an angle to the vertical relative to the engine. The construction provided by the engine is advantageously employed in a boat hull design in which a pocket is formed in the boat hull and a portion of the propeller path is disposed within the pocket. With the transverse placement of the engines, the pockets in the boat hull can extend from the front to the rear of the boat hull and do not require modification to accommodate placement of the engine.

The patents described above are hereby expressly incorporated by reference in the description of the present invention.

In certain boat applications, such as in conjunction with bass boats and other low profile marine vessels, the height of an engine positioned within the hull of the boat often obstructs valuable space in the rear part of the marine vessel. It would therefore be significantly beneficial if a marine propulsion system could be provided in which an engine can be located within the marine vessel, but without requiring the usual height clearance for the engine to be disposed within the marine vessel structure.

SUMMARY OF THE INVENTION

A marine propulsion system made in accordance with a preferred embodiment of the present invention comprises an in-line engine having a plurality of cylinders in which each of the plurality of cylinders has an associated one of a plurality of central axes. The plurality of central axes are disposed within an engine symmetry plane. The in-line engine comprises a crankshaft supported for rotation about a crankshaft axis. A marine propulsion device is connected in torque transmitting relation with the crankshaft. The in-line engine is supported to dispose the engine symmetry plane at a preselected angle relative to a generally vertical plane, with the preselected angle being greater than zero degrees and less than ninety degrees. Throughout the description of the preferred embodiment of the present invention, it should be understood that the vertical plane need not be perfectly or precisely vertical. This terminology is used herein to refer to a plane that is within a few degrees of being perfectly vertical.

The in-line engine can be disposed within a marine vessel that has a hull which is generally symmetrical about a vessel symmetry plane extending from a bow of the vessel to a stern of the vessel. It should be understood that the marine vessel and its hull need not be perfectly symmetrical about the vessel symmetry plane. Certain modifications may be made to a marine vessel which can affect the perfect symmetry about a central plane which bisects the marine vessel. As an example, a steering wheel and associated hardware is typically placed on one side of the vessel symmetry plane. This placement naturally affects the perfect symmetry of the marine vessel but, in the context of the use of the word "symmetry" in the description of a preferred embodiment of the present invention, this slight asymmetry is considered to be within the scope of the terminology "vessel symmetry plane." The crankshaft axis can be disposed parallel the vessel symmetry plane, within the vessel symmetry plane, or perpendicular to the vessel symmetry plane. In one embodiment of the present invention, the preselected angle is disposed on a port side of the generally vertical plane. However, this location of the preselected angle is not required in all embodiments of the present invention. The marine propulsion device can be a sterndrive device or any other device which can be driven by the in-line engine for the purpose of propelling the marine vessel. The term "in-line engine", as used herein, is intended to refer to an engine in which all of the cylinders of the engine are arranged along a line. This terminology is intended to preclude V-type engines.

The preselected angle between the engine symmetry plane and the vertical plane can be between ten and eighty degrees in a preferred embodiment of the present invention and between fifty and seventy degrees in a particularly preferred embodiment of the present invention. It should be understood that many different preselected angles can be used in conjunction with the present invention. In one particularly preferred embodiment of the present invention, the preselected angle is approximately sixty degrees.

BRIEF DESCRIPTION OF THE DRAWINGS

The present invention will be more fully and completely understood from a reading of the description of the preferred embodiment in conjunction with the drawings, in which.

DESCRIPTION OF THE PREFERRED EMBODIMENT

Figure 1:
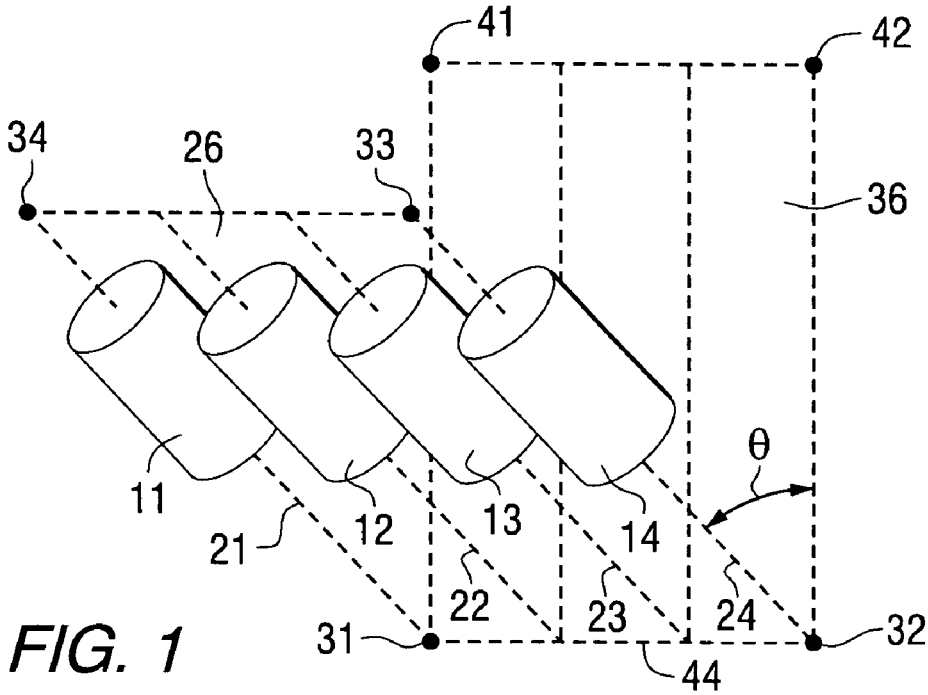
FIGS. 1 and 2 are simplified schematic representations showing the basic concept of the present invention.

Throughout the description of the preferred embodiment of the present invention, like components will be identified by like reference numerals.

FIG. 1 is a schematic representation of the present invention that is provided to show the basic concepts thereof. Four engine cylinders, 11–14, are schematically represented to show their positions in space. The cylinders are intended to represent cylinders of an in-line internal combustion engine. Throughout the description of the preferred embodiment of the present invention, the term "in-line" shall be used to mean that the internal combustion engine comprises a plurality of cylinders that are all disposed with their central axes being arranged in a common plane. That common plane is referred to herein as the "engine symmetry plane." However, it should be clearly understood that this terminology does not require that the engine be perfectly symmetrical about that plane. Instead, it is used herein to represent the plane in which all of the central axes of the cylinders of the in-line engine are disposed. This terminology is selected to intentionally exclude V-type engines from the scope of the present invention.

With continued reference to FIG. 1, it can be seen that the central axes, 21–24, of the plurality of cylinders, 11–14, are all disposed within an engine symmetry plane 26 that is defined by points 31–34, in FIG. 1. A vertical plane 36 is defined by points 31, 32, 41, and 42. The dashed line extending between points 31 and 32 represents a crankshaft axis 44. Although not shown in FIG. 1, those skilled in the art understand that a plurality of pistons would be arranged within the plurality of cylinders, 11–14, for reciprocating motion along paths which are parallel to the central axes, 21–24. Those pistons are connected to a crankshaft by a plurality of connecting rods. The crankshaft is supported by the engine for rotation about the crankshaft axis 44. The in-line engine is supported to dispose the engine symmetry plane 26 at a preselected angle θ relative to the vertical plane 36. The preselected angle is greater than zero degrees and less than ninety degrees.

Figure 2:
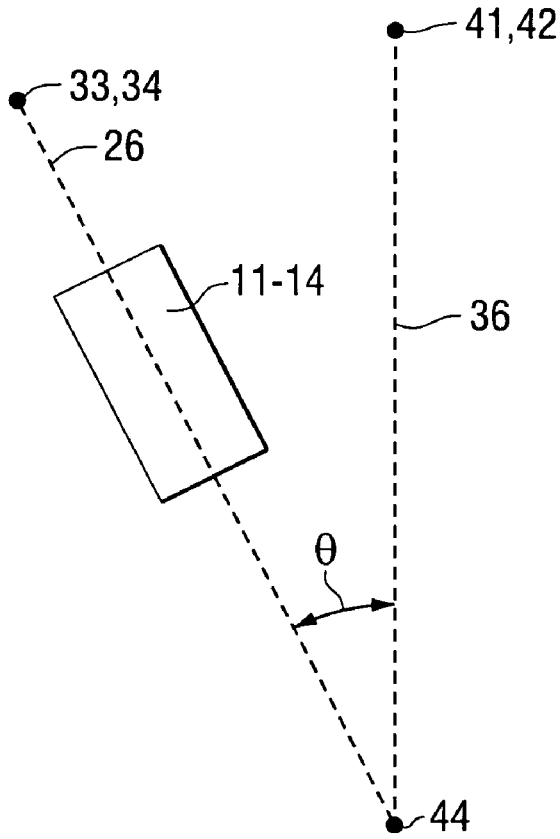

FIG. 2 is a simplified end view representation of the relationship between the engine symmetry plane 26 and a vertical plane 36. These two planes, which are shown intersecting at the crankshaft axis 44, are arranged at the preselected angle θ relative to each other.

Figure 3:
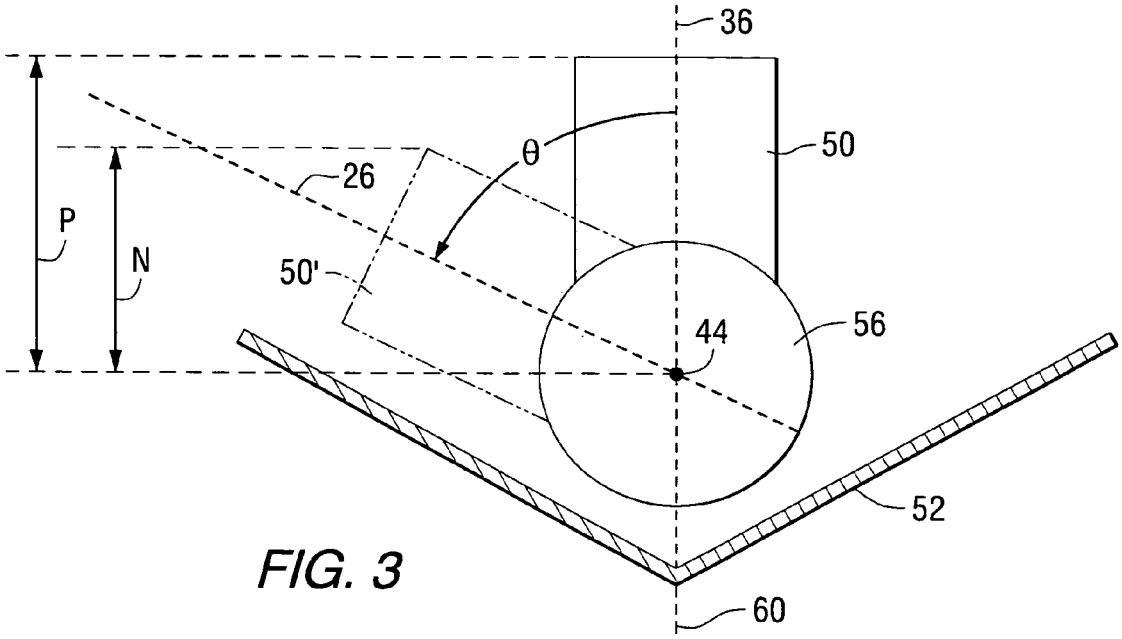
FIG. 3 shows a comparison of the present invention to a standard upright engine in relation to a marine vessel.

FIG. 3 is a schematic representation of an engine 50 disposed within the hull structure 52 of a marine vessel. The engine 50 is shown with a flywheel 56 attached for rotation about its crankshaft axis 44. FIG. 3 is a view taken from a rearward position relative to the engine 50, flywheel 56, and section of the hull 52. A dashed line representation of the engine 50' is also shown in FIG. 3 to illustrate one of the advantages of a preferred embodiment of the present invention. The embodiment shown in FIG. 3 tilts the upright engine 50 to its slanted position 50' without moving the crankshaft axis 44 and while maintaining the position of the crankshaft axis 44 in a vertical plane 36 which also bisects the marine vessel and serves as a vessel symmetry plane 60. It should be understood that not all embodiments of the present invention require the maintenance of the crankshaft axis 44 within the vessel symmetry plane 60.

The tilted engine 50' is positioned in such a way that the engine symmetry plane 26 of the tilted engine 50' is moved by an angle θ from a vertical plane 36. This tilting of the engine, according to a preferred embodiment of the present invention, does not require that the crankshaft axis 44 remain unmoved, as illustrated in FIG. 3, or that the crankshaft axis 44 remain in the vessel symmetry plane 60.

With continued reference to FIG. 3, one of the advantages of a preferred embodiment of the present invention can be seen by comparing the dimensions identified by reference letters P and N. Dimension P represents the maximum clearance height of the top portion of the upright engine 50 relative to the crankshaft axis 44. Dimension N represents the reduced clearance height requirement when the tilted engine 50' is moved so that the engine symmetry plane 26 is located at angle θ relative to a vertical plane 36. Since the flywheel 56 is illustrated in the manner which is shown in FIG. 3, the view of FIG. 3 is taken from the rear of the vessel. In that circumstance, the tilted engine 50' defines angle θ as being located at a port side of the vertical plane 36. However, it should be understood that alternative embodiments of the present invention can tilt the engine to the starboard side to achieve similar beneficial benefits. When used in a marine vessel that has a limited space at the rear portion of the vessel, the reduced dimension, from dimension P to dimension N, allows a beneficial use of space above and proximate the engine compartment of the marine vessel and also preserves a lowered profile of the marine vessel. As an example, the tilting of the engine 50' to achieve dimension N, as opposed to dimension P, can allow the use of a sterndrive marine propulsion system in conjunction with a bass boat, whereas bass boats typically use outboard motors in applications known to those skilled in the art.

Figure 4:
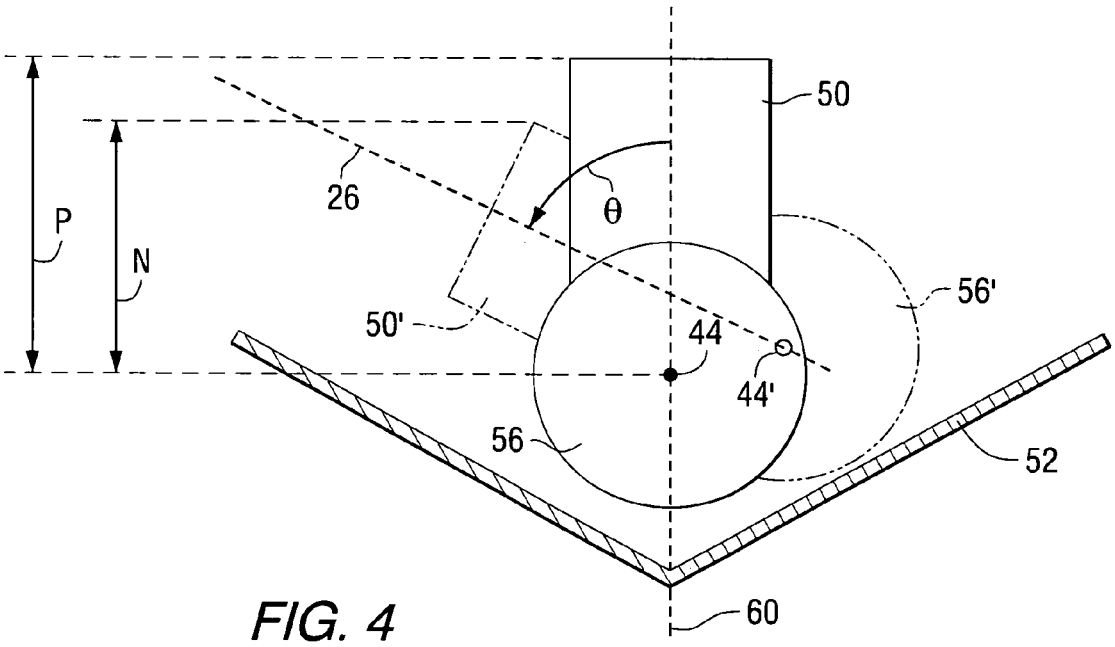
FIG. 4 shows an alternative embodiment of the present invention shown in relation to an upright engine.

FIG. 4 shows an alternative embodiment of the present invention in which the crankshaft axis 44 is also moved to the position identified by reference numeral 44' when the upright engine 50 is moved to its tilted position 50'. This also incorporates a move of the flywheel 56 to the position identified by reference number 56'. The new crankshaft axis 44' position is not located on the vessel symmetry axis 60 but, instead, has been moved toward the starboard side of the vessel and slightly upward from its position 44 with an upright engine. Reference letters P and N again represent the original height P of the top of the upright engine 50 relative to its crankshaft axis 44 and reference letter N now represents the height of the tilted engine 50' relative to the original location of the crankshaft axis 44. The significant benefit provided by a preferred embodiment of the present invention is that the maximum required height of the engine can be reduced by tilting the engine to a preselected angle θ as described above.

Figure 5:
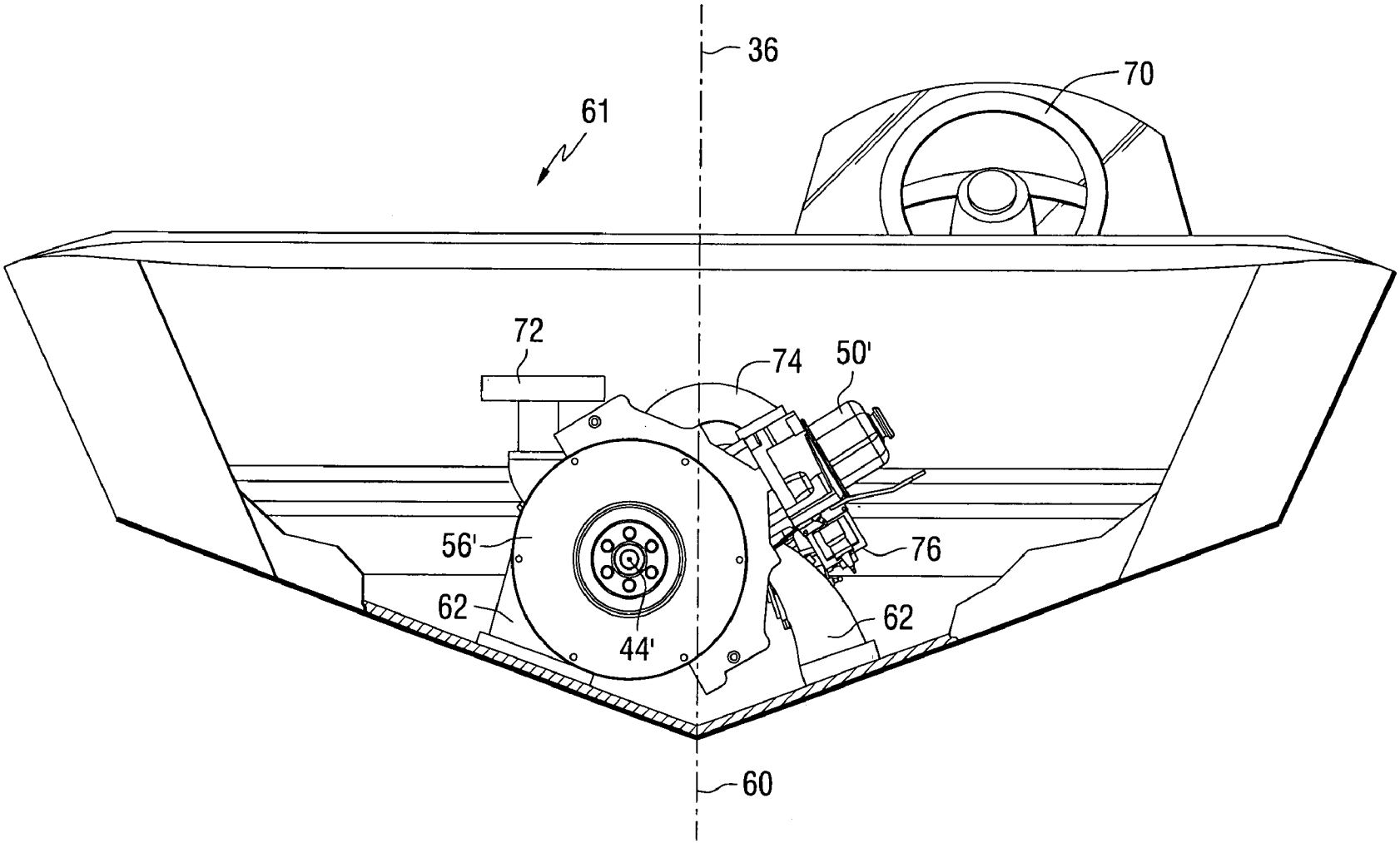
FIG. 5 is a section view taken through a marine vessel showing the present invention located in a bilge portion of the vessel.

FIG. 5 is a section view of a marine vessel 61 showing the position of a tilted engine 50' supported by engine mounting brackets 62 in a bilge portion of the marine vessel 61. A steering wheel 70 is shown in FIG. 5 positioned at a starboard side of the vessel 61. The section view of FIG. 5 is taken from a rearward direction, showing the flywheel 56' of the tilted engine 50'. With continued reference to FIG. 5, it can be seen that the crankshaft axis 44' is shifted toward the port side of both the vessel symmetry plane 60 and the vertical plane 36. In FIG. 5, the vertical plane 36 and the vessel symmetry plane 60 are coincident. In some applications of the present invention, the crankshaft axis 44' can be shifted in a direction opposite to the direction of tilt of the engine in order to maintain a desired location of the center of gravity of the marine propulsion system. However, it should be understood that this is not a requirement in all embodiments of the present invention. Instead, some embodiments can maintain the position of the crankshaft axis 44 within the vessel symmetry plane 60, as described above in conjunction with FIG. 3. Also shown in FIG. 5 are a flame arrestor 72, an intake manifold 74, and a distributor, coil and spark plug 76.

Figure 6:
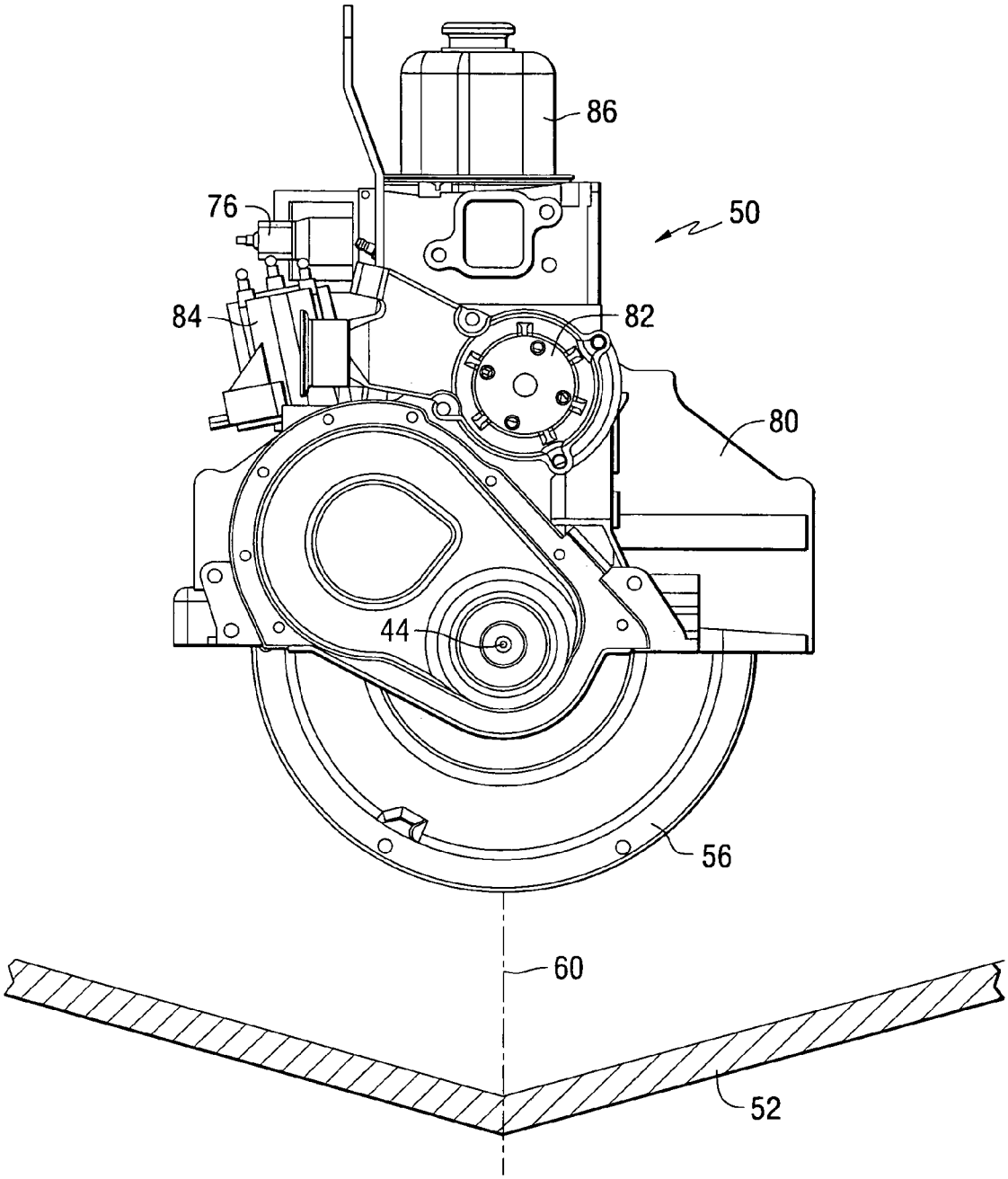
FIG. 6 shows an upright in-line engine in relation to a hull of a marine vessel.

For purposes of reference, FIG. 6 illustrates an in-line engine 50 which is supported with its engine symmetry plane parallel to a vertical plane and with its crankshaft axis 44 aligned, within the vessel symmetry plane 60. In FIG. 6, the concepts of the preferred embodiment of the present invention are not incorporated. For purposes of reference, the illustration in FIG. 6 also shows a block bell housing flange 80, a water pump 82, a distributor cap 84, and a valve cover 86. The illustration in FIG. 6 is a view of the engine 50 taken from in front of the engine. In other words, the flywheel 56 is behind the engine 50 and the distributor cap 84, which is shown on the left side of FIG. 6, is actually on a starboard side of the engine 50.

Figure 7:
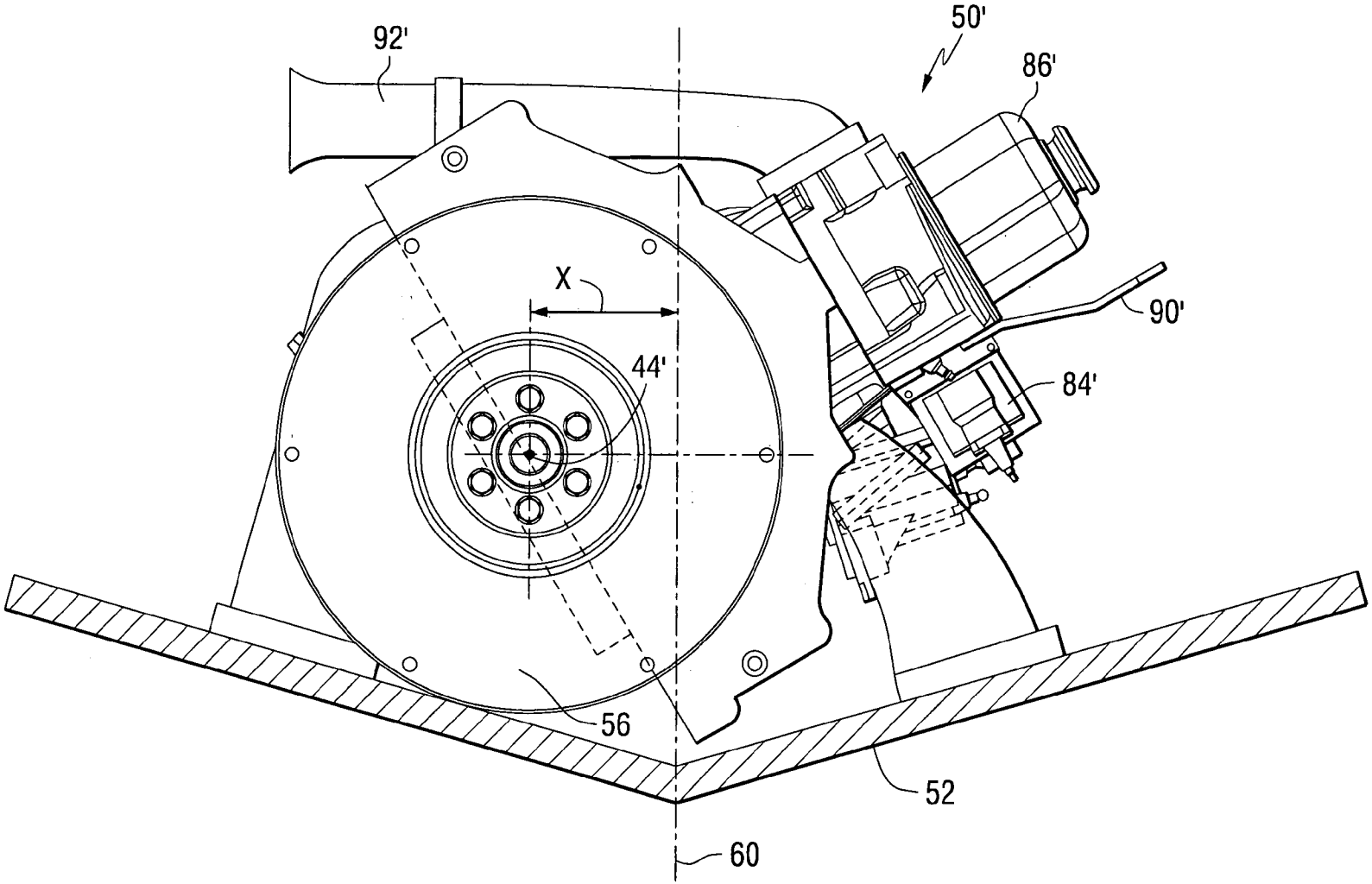
FIG. 7 shows the present invention in relation to a hull of a marine vessel.

FIG. 7 shows a tilted engine 50' with its crankshaft axis 44' offset from the vessel symmetry plane 60 by a dimension X. In FIG. 7, the illustration also shows an engine lifting eye 90 and a throttle body for fuel injection 92. The other components identified in FIG. 7 are similar to those described above.

Figure 8:
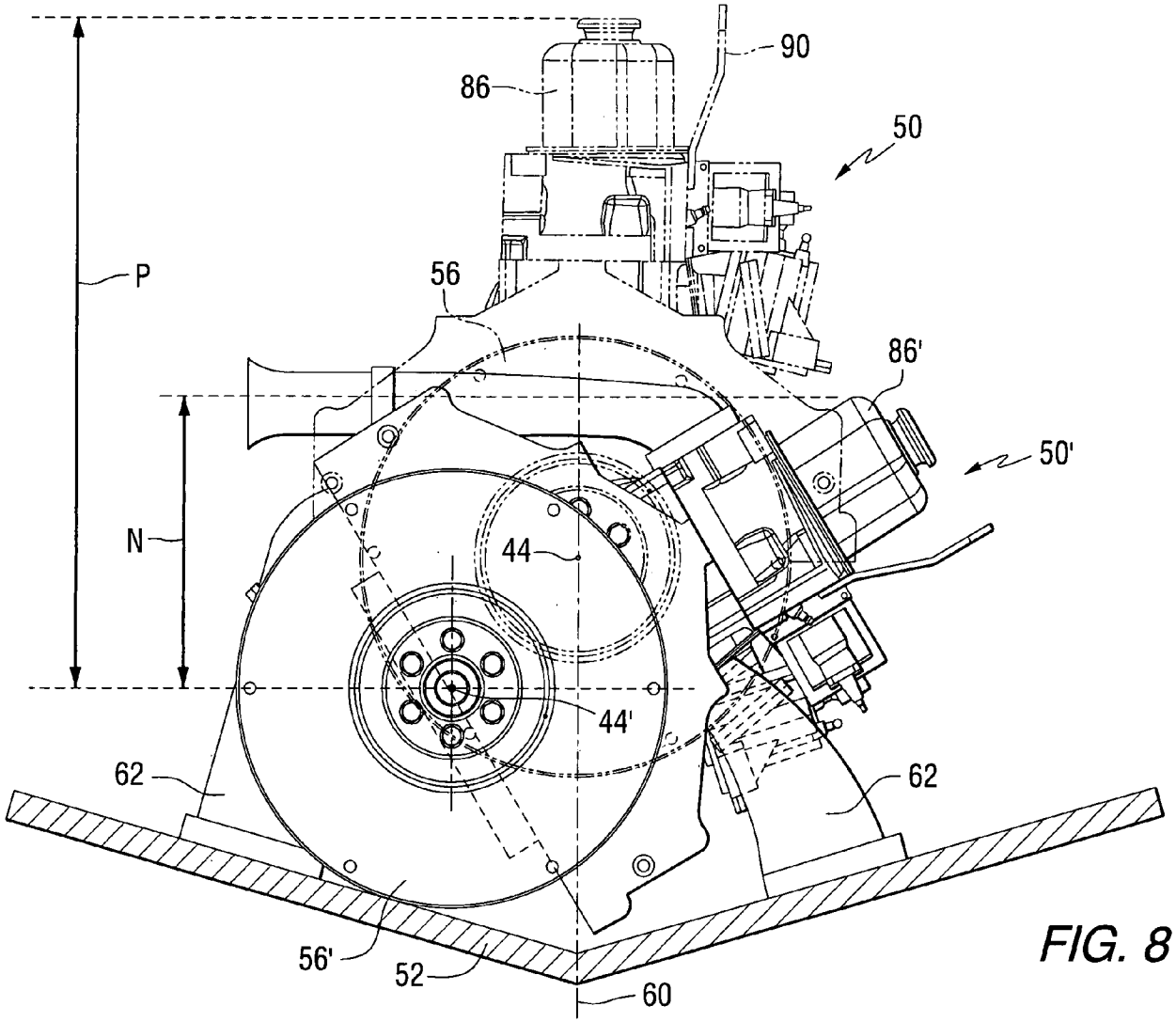
FIG. 8 shows the present invention and a normal upright engine superimposed for comparison relative to a marine vessel.

FIG. 8 shows a tilted engine 50' superimposed over a vertically configured engine 50 which is shown in dashed lines. In the embodiment shown in FIG. 8, the crankshaft axis 44' has been shifted to the left, as identified in FIG. 7 by dimension X, and has been lowered relative to the position of the crankshaft axis 44 of the upright engine 50. The advantage in height requirement achieved by the tilting of the engine 50' in accordance with a preferred embodiment of the present invention can be seen by comparing the original required height P to the lowered required height N.

Figure 9:
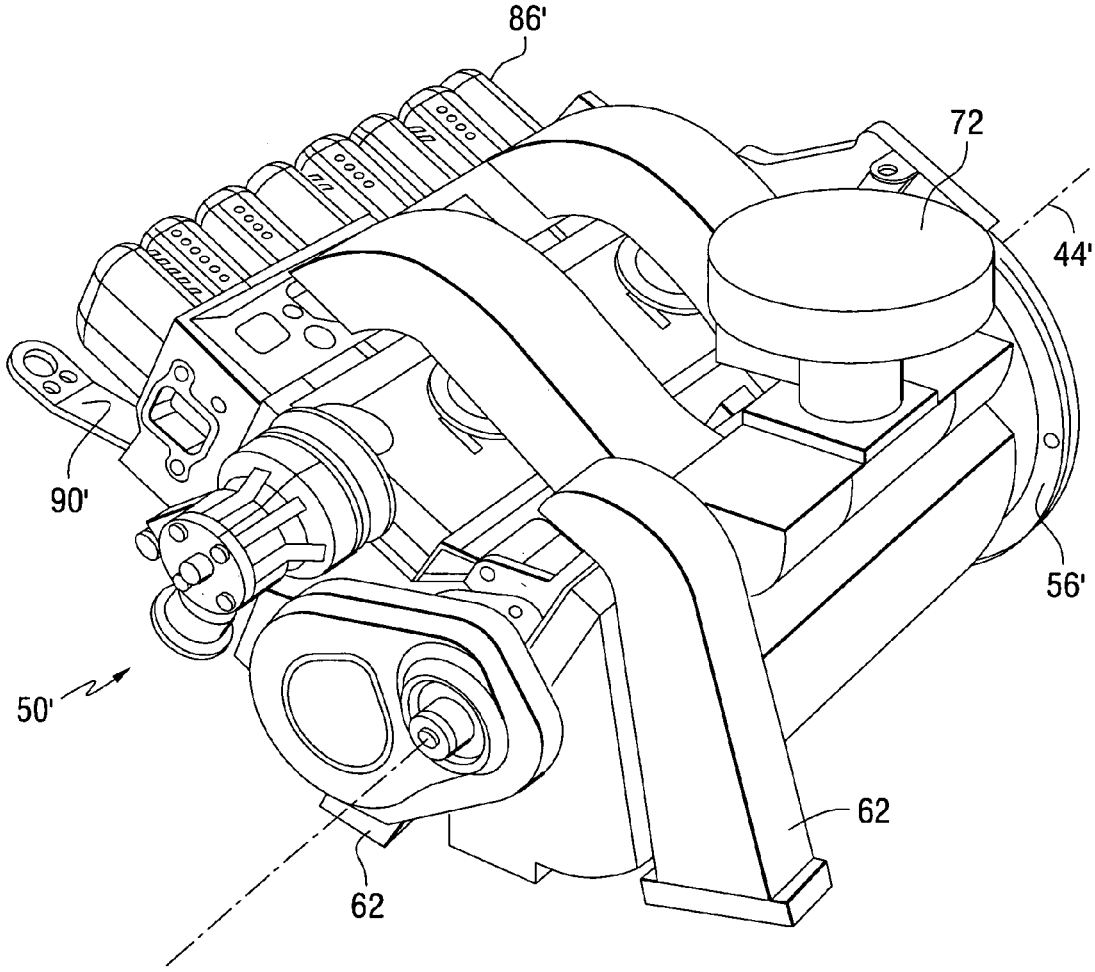
FIG. 9 is an isometric view of an engine made in accordance with a preferred embodiment of the present invention.

FIG. 9 is an isometric view of a tilted engine 50'. The crankshaft axis 44' is shown. The support structure 62 and the flywheel 56' are also illustrated. Not shown in FIG. 9, for the purpose of simplicity and clarity, are the vertical plane 36, the vessel symmetry plane 60, or the engine symmetry plane 26 which are described above in conjunction with FIG. 3.

Figure 10:
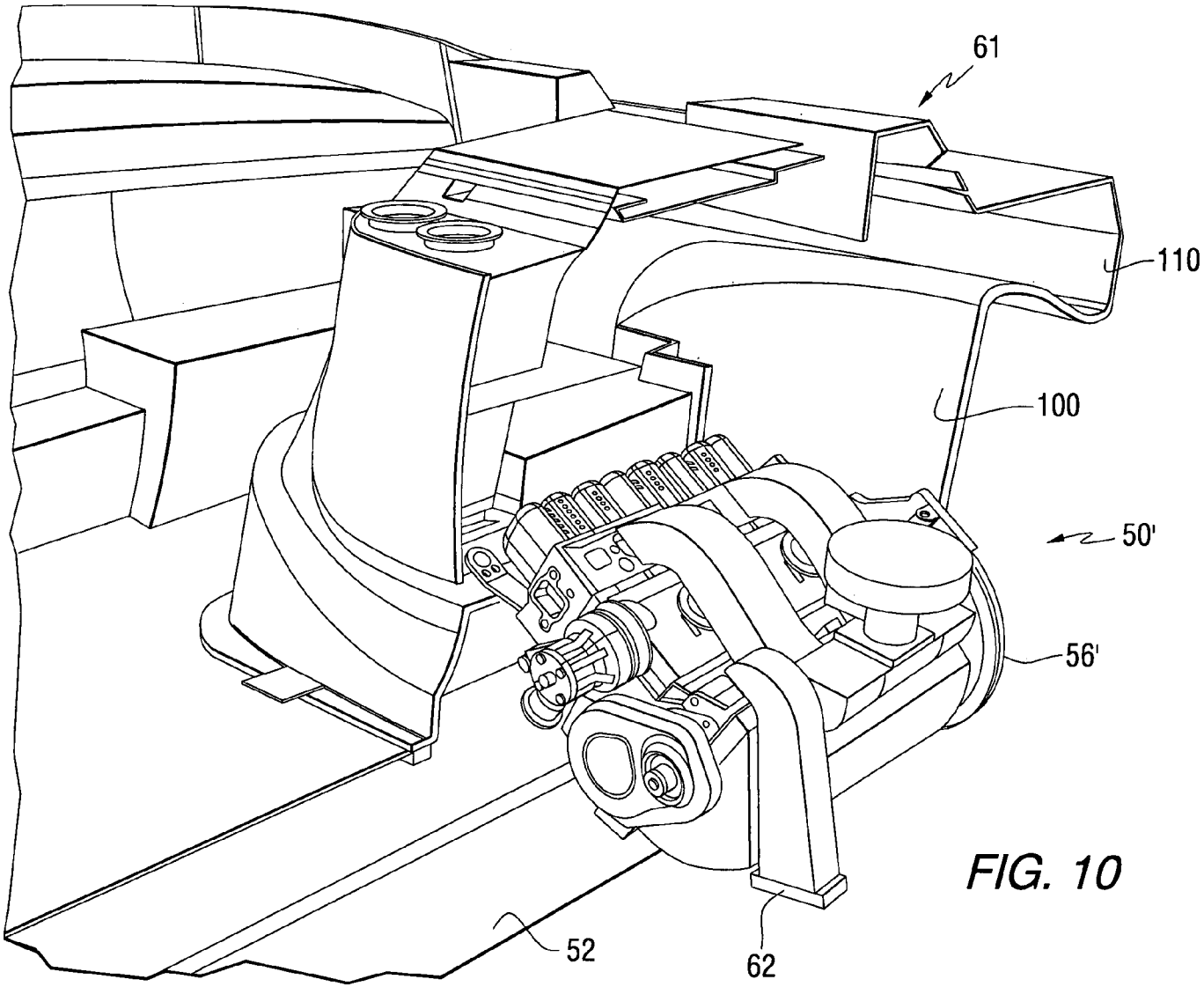
FIG. 10 shows an isometric representation of an engine disposed within a marine vessel.

FIG. 10 shows the tilted engine 50' disposed within a bilge portion of a marine vessel 61. The tilted engine 50' is located near the transom 100 and within an engine compartment defined by an engine cover member 110.

With continued reference to FIGS. 1–10, it can be seen that a marine propulsion system made in accordance with a preferred embodiment of the present invention comprises an in-line engine 51 having a plurality of cylinders, 11–14, wherein each of the plurality of cylinders has an associated one of a plurality of central axes, 21–24. The in-line engine 51 comprises a crankshaft supported for rotation about a crankshaft axis 44. A marine propulsion device, such as a sterndrive device, is connected in torque transmitting relation with a crankshaft of the in-line engine. The in-line engine is supported to dispose the engine symmetry plane 26 at a preselected angle θ relative to a vertical plane 36, wherein the preselected angle θ is greater than zero degrees and less than ninety degrees. In a particularly preferred embodiment of the present invention, such as the embodiment shown in FIGS. 5 and 7, the preselected angle θ is approximately sixty degrees. However, it should be understood that various other magnitudes of the preselected angle θ can be used in different applications of a preferred embodiment of the present invention. In some applications, the preselected angle is between five and eighty five degrees and in others it is between ten and eighty degrees. In some preferred embodiments of the present invention, the preselected angle θ is between fifty and seventy degrees.

The in-line engine is disposed within a marine vessel 61, wherein the marine vessel 61 has a hull 52 which is generally symmetrical about a vessel symmetry plane 60 that extends from a bow of the marine vessel to a stern of the marine vessel and which is generally parallel to a vertical plane. The crankshaft axis 44 can be disposed within the vessel symmetry plane 60 or it can be perpendicular to the vessel symmetry plane. The preselected angle θ can be disposed on a port side of the vertical plane 36 or on a starboard side.

Although a preferred embodiment of the present invention has been described in particular detail and several alternative embodiments are illustrated, it should be understood that other embodiments are within its scope.

I claim:

1. A marine propulsion system, comprising:

an in-line engine having a plurality of cylinders, each of said plurality of cylinders having an associated one of a plurality of central axes, said plurality of central axes being disposed within an engine symmetry plane, said in-line engine comprising a crankshaft supported for rotation about a crankshaft axis; and a marine propulsion device connected in torque transmitting relation with said crankshaft, said in-line engine being supported to dispose said engine symmetry plane at a preselected angle relative to a vertical plane, said preselected angle being greater than zero degrees and less than ninety degrees, said marine propulsion device being selected from the group consisting of a sterndrive device and an inboard propulsion device.

2. The marine propulsion system of claim 1, wherein:

said in-line engine is disposed within a marine vessel, said marine vessel having a hull which is generally symmetrical about a vessel symmetry plane extending from a bow of said marine vessel to a stern of said marine vessel.

3. The marine propulsion system of claim 2, wherein:

said crankshaft axis is disposed parallel to said vessel symmetry plane.

4. The marine propulsion system of claim 2, wherein:

said crankshaft axis is perpendicular to said vessel symmetry plane.

5. The marine propulsion system of claim 2, wherein:

said preselected angle is disposed on a port side of said vertical plane.

6. The marine propulsion system of claim 1, wherein:

said marine propulsion device is a sterndrive device.

7. The marine propulsion system of claim 1, wherein:
said preselected angle is between ten and eighty degrees.

8. The marine propulsion system of claim 2, wherein:
said marine vessel is a bass boat having a transom through which torque is transmitted by said marine propulsion device.

9. The marine propulsion system of claim 1, wherein:
said preselected angle is between fifty and seventy degrees.

10. A marine propulsion system, comprising:
an in-line engine having a plurality of cylinders, each of said plurality of cylinders having an associated one of a plurality of central axes, said plurality of central axes being disposed within an engine symmetry plane, said in-line engine comprising a crankshaft supported for rotation about a crankshaft axis; and
a marine propulsion device connected in torque transmitting relation with said crankshaft, said in-line engine being supported to dispose said engine symmetry plane at a preselected angle relative to a vertical plane, said preselected angle being between than ten degrees and eighty degrees, said marine propulsion device is a sterndrive device, said in-line engine being disposable within a marine vessel, said marine vessel having a hull which is generally symmetrical about a vessel symmetry plane extending from a bow of said marine vessel to a stern of said marine vessel.

11. The marine propulsion system of claim 10, wherein:
said marine vessel is a bass boat having a transom through which torque is transmitted by said marine propulsion device.

12. The marine propulsion system of claim 11, wherein:
said crankshaft axis is parallel to said vessel symmetry plane.

13. The marine propulsion system of claim 11, wherein:
said crankshaft axis is perpendicular to said vessel symmetry plane.

14. The marine propulsion system of claim 12, wherein:
said preselected angle is disposed on a port side of said vertical plane.

15. The marine propulsion system of claim 11, wherein:
said preselected angle is between fifty and seventy degrees.

16. A marine propulsion system, comprising:
an in-line engine having a plurality of cylinders, each of said plurality of cylinders having an associated one of a plurality of central axes, said plurality of central axes being disposed within an engine symmetry plane, said in-line engine comprising a crankshaft supported for rotation about a crankshaft axis; and
a marine propulsion device connected in torque transmitting relation with said crankshaft, said in-line engine being supported to dispose said engine symmetry plane at a preselected angle relative to a vertical plane, said preselected angle being greater than five degrees and less than eighty five degrees, said in-line engine being disposable within a marine vessel having a hull which is generally symmetrical about a vessel symmetry plane extending from a bow of said marine vessel to a stern of said marine vessel, said crankshaft axis being parallel to said vessel symmetry plane, said marine vessel having a transom which comprises a generally vertical wall structure, said marine propulsion device transmitting torque through said transom.

17. The marine propulsion system of claim 16, wherein:
said preselected angle is disposed on a port side of said vertical plane.

18. The marine propulsion system of claim 17, wherein:
said marine propulsion device is a sterndrive device.

19. The marine propulsion system of claim 18, wherein:
said preselected angle is between fifty and seventy degrees.

20. A marine propulsion system, comprising:
an in-line engine having a plurality of cylinders, each of said plurality of cylinders having an associated one of a plurality of central axes, said plurality of central axes being disposed within an engine symmetry plane, said in-line engine comprising a crankshaft supported for rotation about a crankshaft axis; and
a marine propulsion device connected in torque transmitting relation with said crankshaft, said in-line engine being supported to dispose said engine symmetry plane at a preselected angle relative to a vertical plane, said preselected angle being greater than zero degrees and less than ninety degrees, said marine propulsion device being a sterndrive device.

21. The marine propulsion system of claim 20, further comprising:
a marine vessel, said in-line engine is disposed within said marine vessel having a hull which is generally symmetrical about a vessel symmetry plane extending from a bow of said marine vessel to a stern of said marine vessel, said crankshaft axis being parallel to said vessel symmetry plane.

22. The marine propulsion system of claim 21, wherein:
said crankshaft axis is disposed within said vessel symmetry plane.

23. The marine propulsion system of claim 22, wherein:
said preselected angle is disposed on a port side of said vertical plane.

24. The marine propulsion system of claim 23, wherein:
said preselected angle is between ten and eighty degrees.

25. The marine propulsion system of claim 24, wherein:
said preselected angle is between fifty and seventy degrees.

* * * * *